US007699366B2

(12) United States Patent
Hanaki et al.

(10) Patent No.: US 7,699,366 B2
(45) Date of Patent: Apr. 20, 2010

(54) VEHICLE DOOR LOCK

(75) Inventors: Naoki Hanaki, Tokyo (JP); Kiyohiko Kamata, Tokyo (JP)

(73) Assignee: Mitsui Mining and Smelting Co., Ltd. (JP)

( * ) Notice: Subject to any disclaimer, the term of this patent is extended or adjusted under 35 U.S.C. 154(b) by 574 days.

(21) Appl. No.: 11/494,721

(22) Filed: Jul. 27, 2006

(65) Prior Publication Data

US 2008/0078125 A1 Apr. 3, 2008

(51) Int. Cl.
*E05B 3/00* (2006.01)

(52) U.S. Cl. ..... 292/336.3; 292/216; 292/DIG. 46

(58) Field of Classification Search ..... 292/336.3, 292/216, DIG. 46; 49/183, 184; 296/146.2
See application file for complete search history.

(56) References Cited

U.S. PATENT DOCUMENTS 5,492,379 A * 2/1996 Staser et al. ..... 292/336.3
7,222,459 B2 * 5/2007 Taniyama ..... 49/280
2005/0236847 A1 10/2005 Taniyama ..... 292/216

FOREIGN PATENT DOCUMENTS

JP 63-47480 2/1988

* cited by examiner

*Primary Examiner*—Peter M. Cuomo
*Assistant Examiner*—Mark Williams
(74) *Attorney, Agent, or Firm*—Ostrolenk Faber LLP

(57) ABSTRACT

A door latching mechanism of a vehicle door lock engages with a striker fixed to a vehicle body to close a door. An outside handle on the door is operated. Operating force is transmitted via a rod to an intermediate lever below a windowpane in the door and transmitted via a Bowden cable to an operating mechanism. The force is transmitted from the operating mechanism to the door latching mechanism to release the engagement from the latching mechanism to allow the door to open.

9 Claims, 4 Drawing Sheets

VEHICLE DOOR LOCK

BACKGROUND OF THE INVENTION

The present invention relates to a vehicle door lock and particularly to a vehicle door lock enabling operating force from an outside handle on a door to be transmitted to a latching mechanism keeping the door closed via an operating mechanism inside the windowpane of the door.

As disclosed in JP63-47480A and US2005/0236847A1, in a vehicle door lock, it is necessary to transmit operating force from an outside handle disposed outside a windowpane in a door to an operating mechanism disposed inside the windowpane in the door. So, the outside handle and operating mechanism are connected to each other via an operating force transmitting member such as a rod or a cable and an intermediate lever which goes around the lower or front end of the windowpane.

However, in the door lock disclosed in JP63-47480A, the intermediate lever for allowing operating force of the door to go around the lower end of the windowpane is pivotally mounted to the bottom of the door to increase the number of parts and accessories and the number of steps for assembling it to the door, which is disadvantageous.

In US2005/0236847A1, a cable for transmitting operating force from the outside handle is curved from an outer position of the windowpane to an inner position and coupled to the intermediate lever pivotally mounted to a casing for a latching mechanism to decrease operating-force transmitting efficiency of the curved cable and to increase the number of steps for arranging the cable within the door, which is disadvantageous.

SUMMARY OF THE INVENTION

In view of the disadvantages in the prior art, it is an object of the present invention to provide a vehicle door lock simplifying the structure to allow operating force of an outside handle to be transmitted to an operating mechanism smoothly.

BRIEF DESCRIPTION OF THE DRAWINGS

The features and advantages of the invention will become more apparent from the following description with respect to an embodiment as shown in accompanying drawings wherein.

DETAILED DESCRIPTION OF PREFERRED EMBODIMENT

Figure 1:
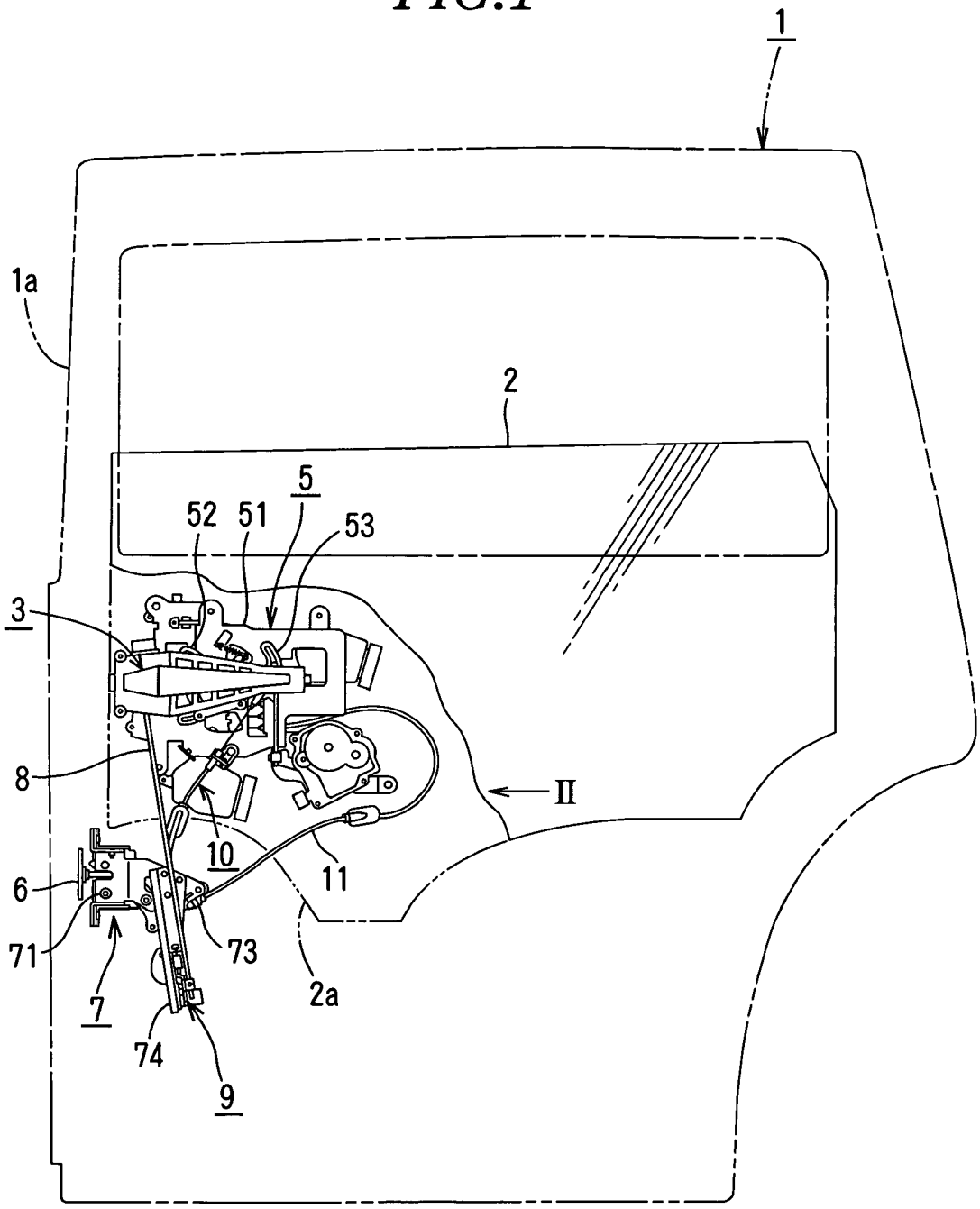
FIG. 1 is a front view of a vehicle door lock according to the present invention.
Figure 2:
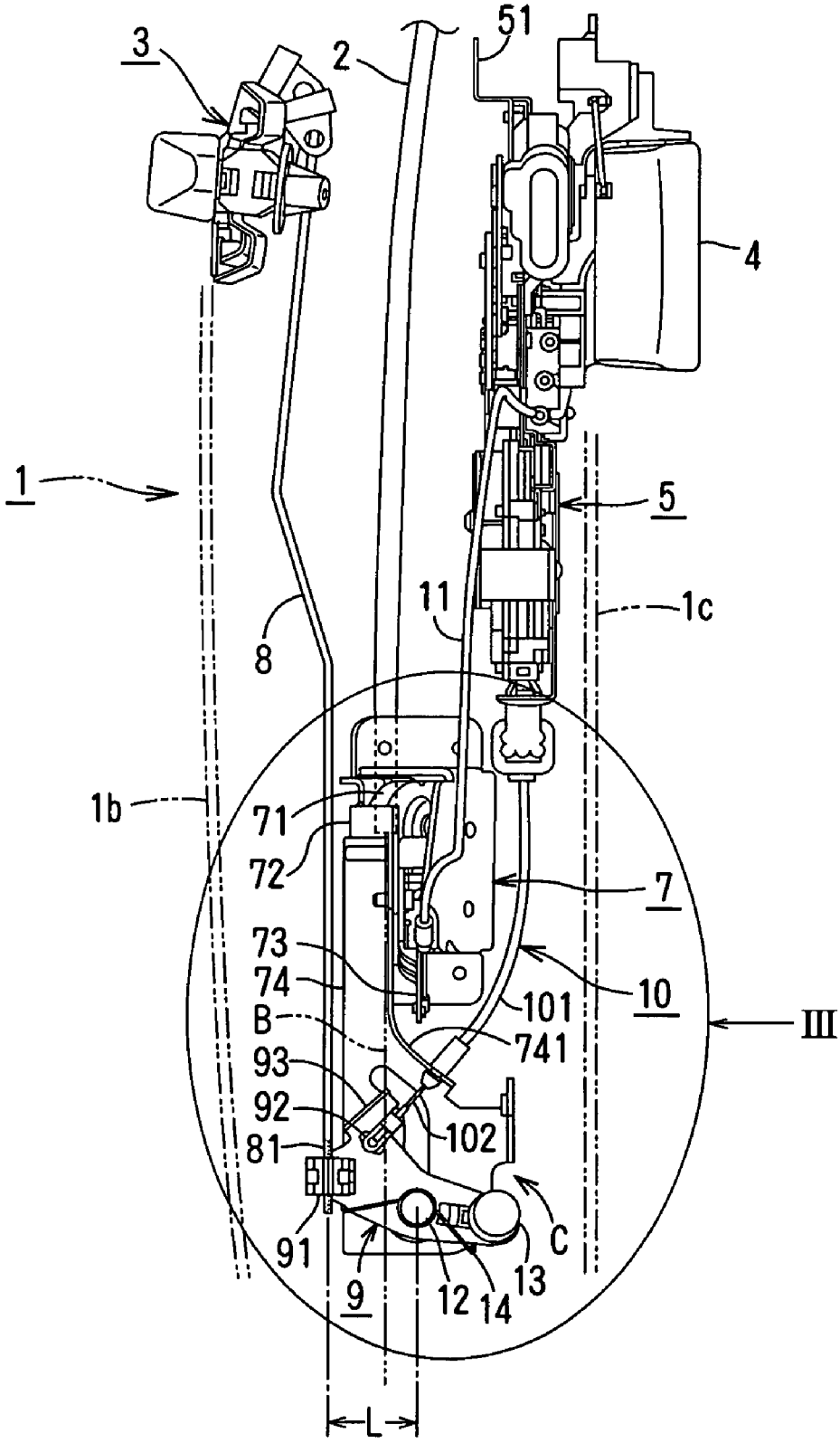
FIG. 2 is an enlarged view seen from the arrow II in FIG. 1.
Figure 3:
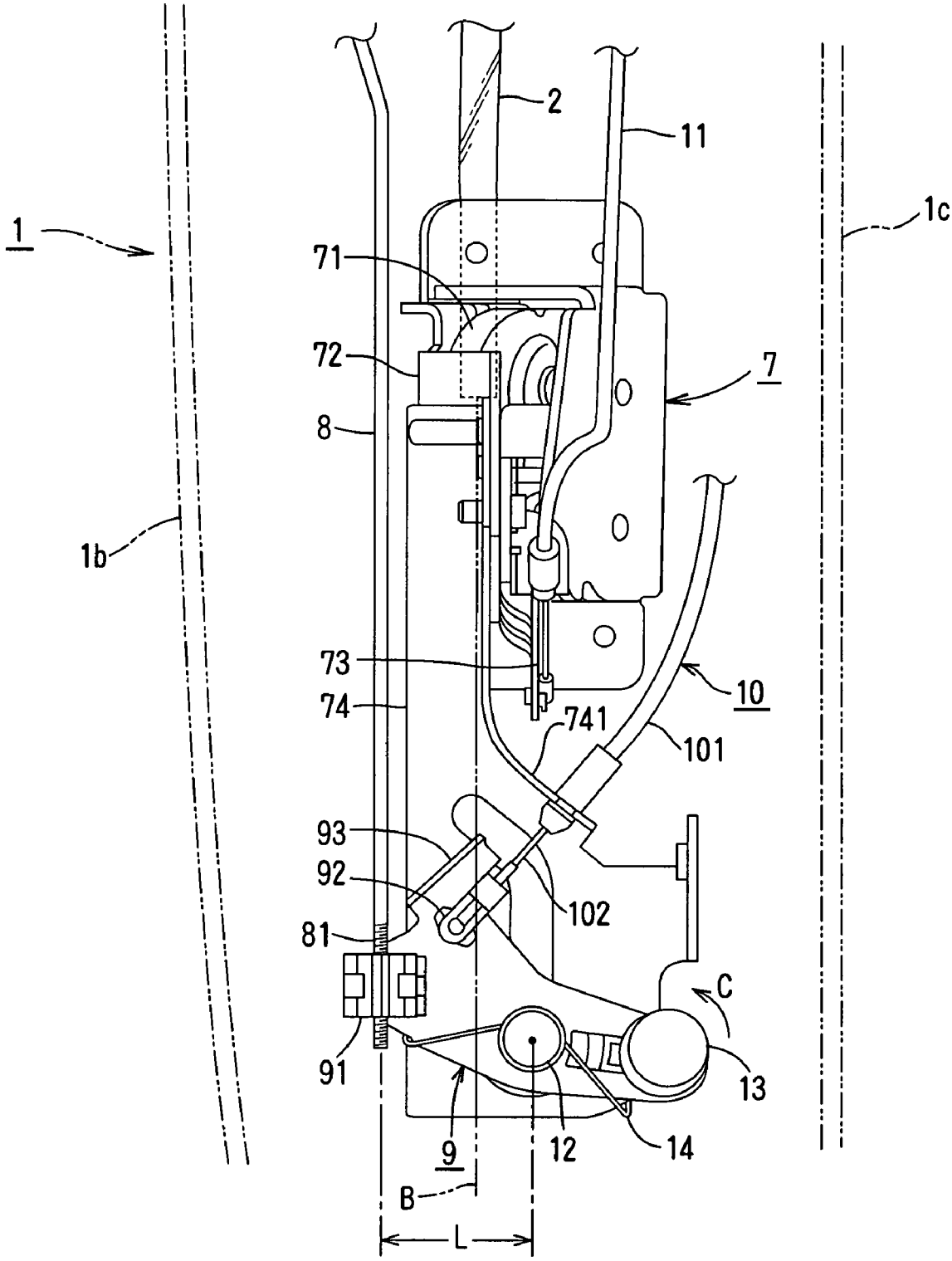
FIG. 3 is an enlarged view seen from the arrow III in FIG. 2.

In the description below, the left side in FIG. 1 and reverse side in FIGS. 2 and 3 are deemed the front, while the right side in FIG. 1 and front side in FIGS. 2 and 3 are the rear. The front side in FIG. 1 and left side in FIGS. 2 and 3 are deemed outside, while the reverse side in FIG. 1 and right side in FIGS. 2 and 3 are inside.

A slide door 1 is supported to open and close back and forth on the side of the body, and a windowpane 2 is provided in a window frame 1*a* in the upper part of the door 1 to open and close up and down.

A vehicle door lock according to the present invention comprises an outside handle 3 disposed outside the windowpane 2 in the door 1 and in the front of an outer panel 1*b* forming the external side surface of the door 1; an operating mechanism 5 disposed in the front of an inner panel 1*c* forming the internal side surface of the door 1 and switched to locking and unlocking based on the operation of a locking/unlocking operating portion (not shown) such as a key cylinder and a locking knob of the door 1; and a front-side door latching mechanism 7 and a rear-side door latching mechanism (not shown) keeping the door 1 closed with engagement with a front striker 6 and a rear striker (not shown) fixed to the body and disposed in the front and rear of the door 1 in a closed position. The rear-side door latching mechanism does not relate to the present invention and is omitted about its illustration and description.

The operating mechanism 5 comprises an outside lever 52; a release lever 53 following the operation of an outside lever 52 during unlocking; and a knob lever (not shown) following the operation of the locking/unlocking portion, on a base plate 51 fixed to the inner panel 1*c*. The release lever 53 is connected to a disengagement lever 73 (described later) of the front-side door latching mechanism and a rear-side door latching mechanism via a third operating force transmitting member 11 (described later) and another operating force transmitting member.

Unlocking of the operating mechanism 5 means that either the outside handle 3 or inside handle 4 of the operating mechanism 5 releases the engagement of the front-side door latching mechanism 7 and rear-side door latching mechanism to enable the door 1 to open. Locking means that neither the outside handle 3 nor inside handle 4 enables disengagement of the front-side door latching mechanism 7 or rear-side door latching mechanism to make it impossible for the door to open.

Figure 4:
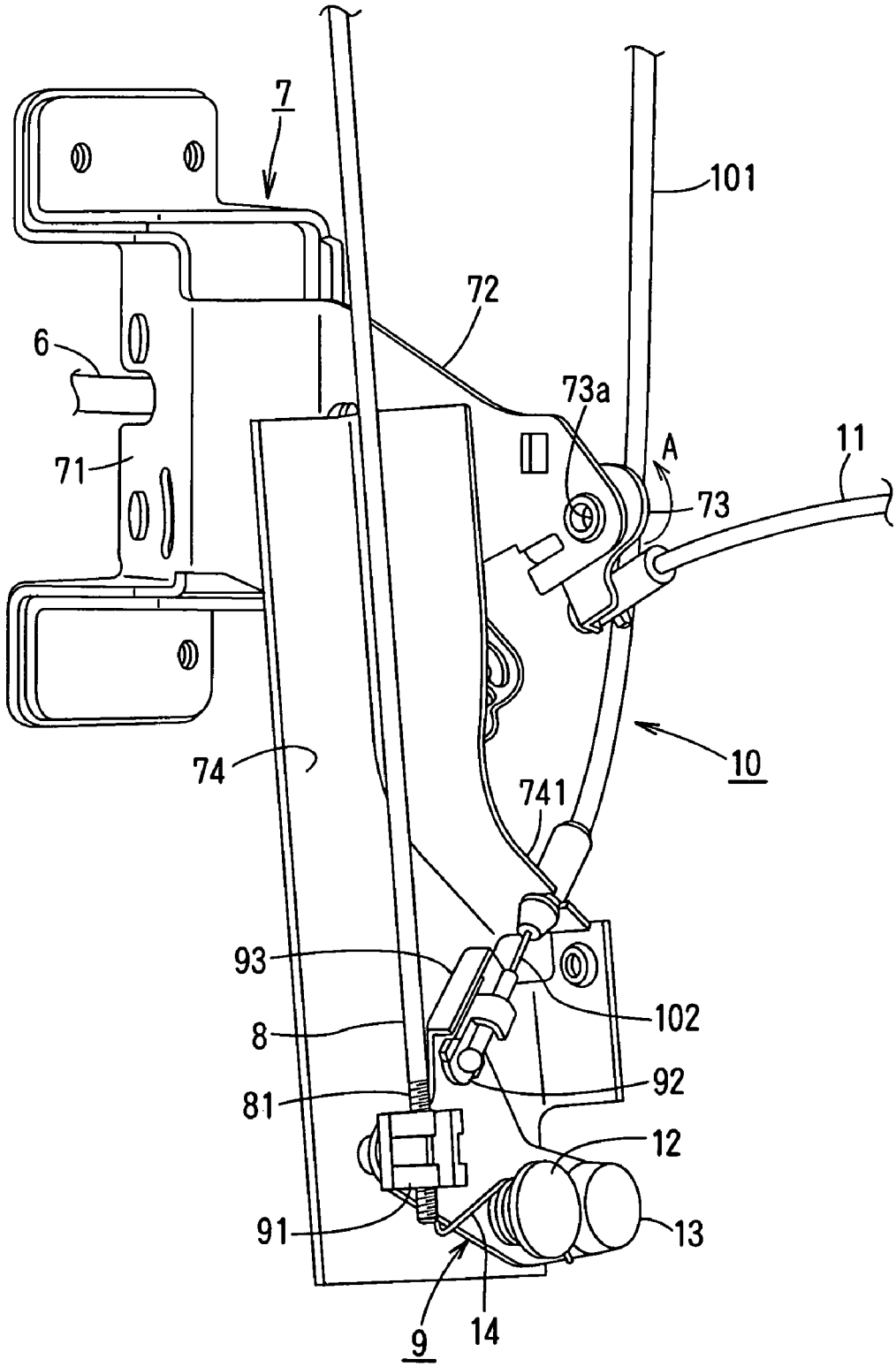
FIG. 4 is a perspective view of the vehicle door lock of the present invention.

When the windowpane 2 goes down to a full-open position in FIG. 1, the front-side door latching mechanism 7 is disposed below a notch 2*a* at the front lower end of the windowpane 2 and under the outside handle 3 and the operating mechanism 5, and comprises an engagement portion 71 which engages with the front-side striker 6 to keep the door 1 closed, and an engagement release lever 73 pivoted on a pivot 73*a* passing through a first base plate 72 in a depth or thickness direction to release engagement of the engagement portion 71 as shown by an arrow A in FIG. 4. The engagement portion 71 is released to enable the door 1 to open.

The engagement release lever 73 is connected to a release lever 53 of the operating mechanism 5 via the third operating force transmitting member 11 comprising a Bowden cable enabling the release lever 53 which follows the operation of the outside lever 52. The notch 2*a* of the windowpane 2 enables the windowpane 2 to open broader and enables the front-side latching mechanism 7 to be disposed at a higher position thereby reducing a distance between the operating mechanism 5 and an intermediate lever 9 to improve transmitting efficiency.

A second base plate 74 extending downwards is fixed to a first base plate 72 of the front-side door latching mechanism 7. The second base plate 74 may be integrally formed with the first base plate 72.

Under the engagement release lever 73 of the second base plate 74, the intermediate lever 9 is pivotally mounted on a pivot 12 extending in a width direction of the door 1 such that the lever 9 moves up and down perpendicular to the width direction of the door 1 or along the depth direction of the door 1.

In FIG. 2, a counterweight 13 is provided at the other end of the intermediate lever 9 to keep balance so that the lever 9 does not turn along a releasing direction as shown by an arrow C in FIGS. 2 and 3 owing to inertia force which acts upon the door 1. A spring 14 urges the intermediate lever 9 to move opposite to the releasing direction C.

In the intermediate lever 9, a first coupling portion 91 at the outer end is coupled to the lower end of a first operating force transmitting member 8 which extends vertically to enable operating force to be transmitted from the outside handle 3, and a second coupling portion 92 is coupled to the lower end of a second operating force transmitting member 10 which extends vertically to enable action of the intermediate lever 9 to be transmitted to an outside lever 52 of the operating mechanism. The first coupling portion 91 engages on a thread 81 at the lower end of the first operating force transmitting member 8 to enable its position to be adjusted up and down with respect to the first operating force transmitting member 8.

In FIGS. 2 and 3, the pivot 12 at the center of rotation of the intermediate lever 9 is disposed in a position in a direction toward the interior of the vehicle with respect to an imaginary windowpane vertical line B extending from a bottom surface of the windowpane 2 downwards vertically.

The first coupling portion 91 of the intermediate lever 9 is disposed under the outside handle 3 in a position in a direction toward the exterior of the vehicle with respect to the imaginary windowpane vertical line B. The second coupling portion 92 is disposed in a position in a direction toward the exterior of the vehicle with respect to the imaginary windowpane vertical line B as well as the first coupling portion 91.

The first operating force transmitting member 8 comprises a metal circular rod which enables pressing force to be transmitted downwards. The first operating force transmitting member 8 is coupled at the upper end to a moving portion of the outside handle 3 and coupled at the lower end to the first coupling portion 91 of the intermediate lever 9, so that downward movement follows opening/closing of the outside handle 3 to transmit operating force of the outside handle 3 to the intermediate lever 9 to release the intermediate lever 9 thereby moving the first and second coupling portions 91,92 down. The first operating force transmitting member 8 may comprise a Bowden cable.

The second operating force transmitting member 10 is coupled at the upper end to the outside lever 52 and coupled at the lower end to the second coupling member 92 of the intermediate lever 9, so that release of the intermediate lever 9 by the outside handle 3 is transmitted to the outside lever 52 of the operating mechanism 5 to release the outside lever 52. When the operating mechanism 5 is in an unlocked position, the release lever 53 follows the operation of the outside lever 52 to release engagement of the front-side door latching mechanism 7 and rear-side door latching mechanism via the third operating force transmitting member 11.

In this embodiment, the second operating force transmitting member 10 comprises a Bowden cable which enables pulling force to be transmitted. An inner cable 102 which extends through the outer cable 101 is coupled at the upper end to the outside lever 52 and coupled at the lower end to the second coupling portion 92 of the intermediate lever 9. The lower end of the outer cable 101 is fixed to the lower part of a bent portion 741 of the second base plate 74. The second operating force transmitting member 10 may comprise a rod.

The bent portion 741 of the second base plate 74 covers the inner cable 102 exposed from the lower end of the outer cable 101, thereby receiving drops of water invaded into the door 1 to prevent them from coming on the inner cable 102 and preventing malfunction owing to freezing on the Bowden cable. Above the second coupling portion 92 of the intermediate lever 9, a bent portion 93 of the intermediate lever 9 covers the inner cable 102. The bent portion 93 receives drops of water invaded into the door 1 to prevent moistening of the inner cable 102 of the Bowden cable thereby preventing malfunction by freezing on the Bowden cable.

As described above, the pivot 12 is disposed in a position in a direction toward the interior of the vehicle with respect to the imaginary windowpane vertical line B and the first coupling portion 91 is disposed in a position in a direction toward the exterior of the vehicle with respect to the imaginary windowpane vertical line B to increase distance L between the center of rotation of the pivot 12 of the intermediate lever 9 and the first coupling portion 91 or a force-working point. Thus, up-and-down movement of the first operating force transmitting member 8 based on the operation of the outside handle 3 enables the intermediate lever 9 to move up and down smoothly. Furthermore, the first and second coupling portions 91, 92 are provided at one part in a position in a direction toward the exterior of the vehicle with respect to the imaginary windowpane vertical line B of the windowpane 2 in the intermediate lever 9, thereby reducing the length of the intermediate lever 9 along the depth direction of the door 1 and providing the intermediate lever 9 in a limited small space of the door 1.

When the first operating force transmitting member 8 comprises a rod, the first coupling portion 91 of the intermediate lever 9 is disposed under the outside handle 3 thereby connecting the outside handle 3 and the first coupling portion 91 of the intermediate lever 9 almost in line vertically by the first coupled member 8. Thus, operating force is surely transmitted from the outside handle 3 to the intermediate lever 9.

When the second operating force transmitting member 10 comprises a Bowden cable, the second coupling portion 92 of the intermediate lever 9 disposed in a position in a direction toward the exterior of the vehicle with respect to the imaginary windowpane vertical line B of the windowpane 2 can easily be connected to the operating mechanism 5 located in a position in a direction toward the interior of the vehicle with respect to the imaginary windowpane vertical line B of the windowpane 2.

When the intermediate lever 9 is disposed under the engagement release lever 73 of the front-side latching mechanism 7, the pivot 12 can easily be provided in a position in a direction toward the interior of the vehicle with respect to the imaginary windowpane vertical line B without hindrance by the space of the engagement release lever 73.

The foregoing merely relates to an embodiment of the invention. Various modifications and changes may be made by a person skilled in the art without departing from the scope of claims wherein:

What is claimed is:

1. A vehicle door lock comprising:

an outside handle on a door of a vehicle;

a latching mechanism enabling the door to close;

an operating mechanism located in a position in a direction toward the interior of the vehicle with respect to an imaginary vertical windowpane line extending downwardly from a bottom surface of the windowpane in the door;

an intermediate lever pivotally mounted on a pivot to the latching mechanism under the windowpane, said pivot being disposed in a position in a direction toward the interior of the vehicle with respect to the imaginary windowpane vertical line, said pivot having an axis about which it rotates, the axis extending along a length of the vehicle, said intermediate lever having first and second coupling portions disposed in a position in a direction toward the exterior of the vehicle with respect to the imaginary windowpane vertical line;

a first operating force transmitting member comprising a rod that is coupled at an upper end to said outside handle and coupled at a lower end to the first coupling portion of said intermediate lever to enable an operating force to be transmitted from the outside handle to the intermediate lever; and a second operating force transmitting member comprising a Bowden cable that comprises an outer cable and an inner cable, the inner cable being coupled at a lower end of the second operating force transmitting member to the second coupling portion of the intermediate lever and the second operating force transmitting member being coupled at an upper end to said operating mechanism to enable the operating force to be transmitted from the intermediate lever to the operating mechanism.

2. A vehicle door lock according to claim 1 wherein a lower end of the outer cable is fixed to a bent portion of a base plate of the latching mechanism to cover the inner cable of the Bowden cable.

3. A vehicle door lock according to claim 1 wherein a bent portion is formed at an upper end of the intermediate lever to cover the inner cable of the Bowden cable.

4. A vehicle door lock according to claim 1 wherein the intermediate lever has a counterweight at an inner end so that an inertia force acting upon the door does not cause the intermediate lever to turn in a releasing direction.

5. A vehicle door lock according to claim 1 wherein the first coupling portion engages with a thread formed on the lower end of the first operating force transmitting member to allow adjustment of a vertical position of the first coupling portion, the first coupling portion being disposed under the outside handle.

6. A vehicle door lock according to claim 1 wherein a spring is mounted around the pivot of the intermediate lever to urge the intermediate lever to move in an opposite direction to a releasing direction.

7. A vehicle door lock according to claim 1 wherein the windowpane has a notch at a lower end, said intermediate lever and latching mechanism being disposed under the notch even when the windowpane moves down to a lower limit.

8. A vehicle door lock according to claim 1, further comprising a third operating force transmitting member that is coupled at an upper end to the operating mechanism and coupled at a lower end to the latching mechanism to enable the operating force to be transmitted from the operating mechanism to the latching mechanism.

9. A vehicle door lock according to claim 8, wherein the third operating force transmitting member comprises a Bowden cable.

* * * * *